US006031462A

United States Patent [19]

Van den Schoor et al.

[11] Patent Number: 6,031,462

[45] Date of Patent: Feb. 29, 2000

[54] RATE OF RISE DETECTOR FOR USE WITH EXPLOSION DETECTION SUPPRESSION EQUIPMENT

[75] Inventors: Marc Van den Schoor, Antwerpen-Ekeren; Sven J. R. De Vries, Schoten, both of Belgium

[73] Assignee: Fike Corporation, Blue Springs, Mo.

[21] Appl. No.: 09/185,461

[22] Filed: Nov. 3, 1998

[51] Int. Cl.[7] ..... G08B 21/00

[52] U.S. Cl. ..... 340/626; 340/603; 702/138; 73/31.04

[58] Field of Search ..... 340/603, 626; 702/98, 138, 140; 73/1.57, 1.71, 23.29, 31.04

[56] References Cited

U.S. PATENT DOCUMENTS

| | | |
|---|---|---|
| 2,736,386 | 2/1956 | Klompar . |
| 2,799,781 | 7/1957 | Joyce et al. . |
| 2,868,300 | 1/1959 | Joerren et al. . |
| 3,628,563 | 12/1971 | Temita . |
| 3,748,656 | 7/1973 | Gray et al. . |
| 3,831,318 | 8/1974 | Richmond . |
| 3,884,077 | 5/1975 | Athy, Jr. . |
| 3,895,527 | 7/1975 | McArthur . |
| 4,055,844 | 10/1977 | Hornbostel, Jr. . |
| 4,212,004 | 7/1980 | Bensemann . |
| 4,267,889 | 5/1981 | Williams . |
| 4,357,534 | 11/1982 | Ball . |
| 4,499,952 | 2/1985 | Spector et al. . |
| 4,509,601 | 4/1985 | Spector et al. . |
| 4,583,597 | 4/1986 | Spector et al. . |
| 4,691,783 | 9/1987 | Stern et al. . |
| 4,718,497 | 1/1988 | Moore et al. . |
| 4,823,224 | 4/1989 | Hagerman et al. . |
| 4,928,255 | 5/1990 | Brennecke et al. . |
| 4,986,366 | 1/1991 | O'Connell . |
| 5,124,709 | 6/1992 | Baron et al. . |
| 5,260,687 | 11/1993 | Yamauchi et al. . |
| 5,483,826 | 1/1996 | Schultz et al. . |
| 5,526,678 | 6/1996 | Shaw et al. ..... 73/40 |
| 5,578,993 | 11/1996 | Sitabkhan et al. . |
| 5,660,236 | 8/1997 | Sears et al. . |
| 5,718,294 | 2/1998 | Billiard et al. . |
| 5,754,449 | 5/1998 | Hoshal et al. . |
| 5,754,452 | 5/1998 | Pupalaikis . |
| 5,774,372 | 6/1998 | Berwanger . |

*Primary Examiner*—Edward Lefkowitz
*Attorney, Agent, or Firm*—Hovey, Williams, Timmons & Collins

[57] ABSTRACT

A rate of rise detector assembly (16) for use with explosion suppression equipment (14,18). The detector assembly includes a pressure sensor or transducer (20) and a controller (22). The pressure transducer continuously measures the pressure in a protected area and sends signals representative of the pressure to the controller. The controller samples the transducer every 200 $\mu$Sec to obtain a series of successive pressure measurements. The sampled pressure measurements are then stored in a memory table (28) having five positions. Each time the table is filled, the five pressure measurements are averaged to obtain an integrated mean pressure value having a sample time of 1 mSec and then erased from the table so that it can be filled with subsequent measurements. This results in the calculation of a series of mean pressure values each having a sample time of 1 mSec. The mean pressure values are each stored in a line of an ROR (rate of rise) table (34) having between 5 and 25 positions each corresponding to a 1 mSec time period. The mean pressure values are stored in the table starting at the top until the table overflows, at which time the mean pressure values beginning at the top of the table are overwritten with new mean pressure values. When the table has been filled, the latest value written in the table is always the mean pressure value for the most current mSec period and the value below it in the table is always the mean pressure value that was measured "dt" times before (5–25 mSec before, depending on the length of the table). The controller calculates a dP/dt validation value every mSec by taking the most recent mean pressure value in the table and subtracting the mean pressure value that is in the next lower line of the table and dividing this difference by the dt value. The controller compares the calculated dP/dt values to a predetermined threshold dP/dt rate and triggers the explosion suppression equipment if any of the calculated dP/dt validation values exceed the threshold rate.

20 Claims, 2 Drawing Sheets

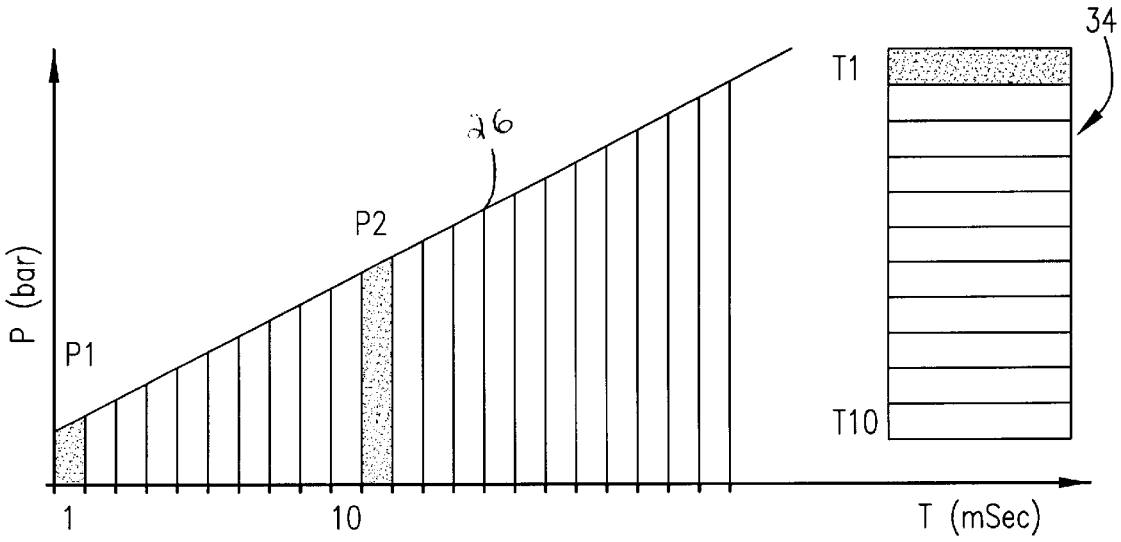
FIG. 3.
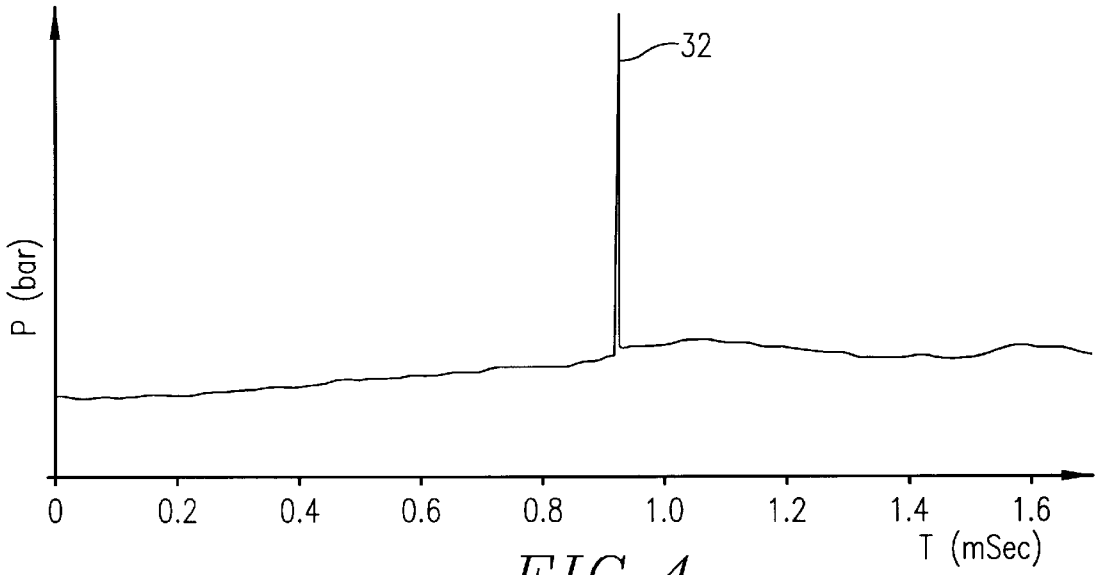
FIG. 4.
FIG. 5.
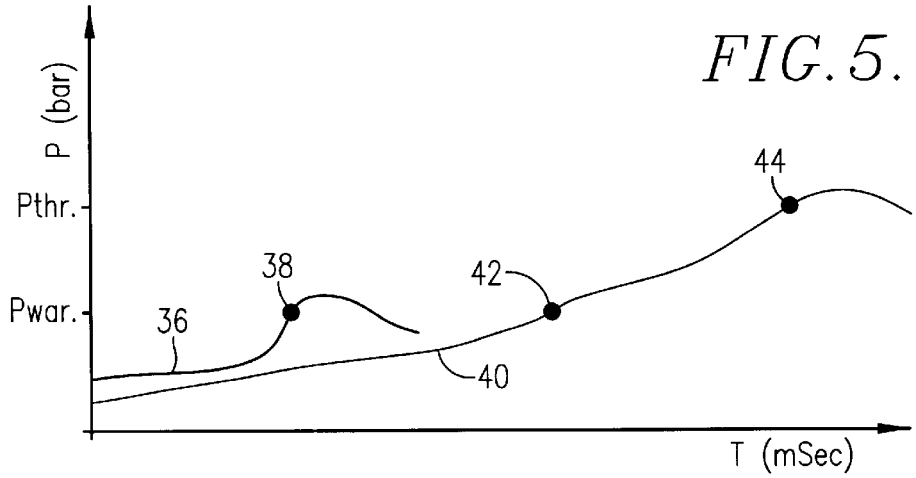

RATE OF RISE DETECTOR FOR USE WITH EXPLOSION DETECTION SUPPRESSION EQUIPMENT

BACKGROUND OF THE INVENTION

1. Field of the Invention

The present invention relates to explosion detection and suppression systems for detecting and preventing explosions in protected areas. More particularly, the invention relates to a rate of rise detector that accurately and reliably detects pressure increases in a protected area and then triggers explosion suppression equipment for preventing and/or inhibiting explosions in the protected area.

2. Description of the Prior Art

Explosion protection systems are commonly installed in industrial and commercial areas for preventing explosions in protected areas. These systems include a detector assembly that measures pressure increases in the protected area and then triggers explosion suppression equipment when the pressure rises at a rate above a threshold rate or reaches an absolute pressure level above a threshold pressure level.

Unfortunately, prior art detector assemblies often fail to quickly and reliably trigger their corresponding suppression equipment because of the manner in which they calculate pressure increases. Specifically, prior art detector assemblies determine the rate of pressure rise (dP/dt) in a protected area by sampling the pressure in the area at pre-determined time intervals and then determining the difference between the most recent pressure measurement and the immediate preceding pressure measurement. This difference is then divided by the time interval between the two pressure measurements, and the result is compared to a threshold rate. If the calculated rate exceeds the threshold rate, the detector assembly triggers the suppression equipment.

This method of determining the rate of pressure rise is slow and inaccurate for a number of reasons. First, momentary pressure variations and electromagnetic disturbances that occur within the protected areas often cause spikes in the measured pressure readings, thus resulting in inaccurate pressure rise calculations. To accommodate for these inaccurate readings and to prevent inadvertent triggering of the suppression equipment, prior art detector assemblies do not trigger their corresponding suppression equipment until several of the calculated rates have exceeded the threshold rate over an extended time period. Although this delay reduces the frequency of inadvertent triggering of the suppression equipment, it also delays the triggering of the suppression equipment when the pressure actually is rising at dangerous rates and therefore reduces the effectiveness of the suppression equipment.

Another related problem with prior art detector assemblies is that these same momentary pressure variations and electromagnetic disturbances also often cause monitored absolute pressure readings to exceed the absolute threshold level, again resulting in inadvertent triggering of the suppression equipment. As with the rate of rise pressure calculations, prior art detector assemblies accommodate for these inaccurate readings by delaying the triggering of the suppression equipment until the monitored absolute pressure readings exceed the absolute threshold level for a predetermined time interval. Once again, this delays the triggering of the suppression equipment during actual explosive conditions.

Prior art detector assemblies are also limited because they are typically configured for use with a particular protected area and cannot be easily reconfigured for use in a different area having dissimilar operating characteristics. The threshold rates of prior art detector assemblies are also difficult to adjust without comprising the accuracy of the detectors.

OBJECTS AND SUMMARY OF THE INVENTION

The present invention solves the above-described problems and provides a distinct advance in the art of explosion detection and suppression equipment. More particularly, the present invention provides a detector assembly that more accurately and reliably distinguishes between momentary pressure variations and actual deflagrations and that responds more quickly to actual deflagrations and triggers corresponding suppression equipment. The present invention also provides a detector whose threshold rate can be quickly and easily changed to adjust the sensitivity of the detector and a detector that can be easily configured for use in multiple areas with various operating characteristics.

The detector assembly of the present invention broadly includes at least one pressure sensor or transducer and a controller. The pressure transducer, which is conventional, continuously measures the pressure in a protected area and sends signals representative of the measured pressure to the controller. The controller responds to the pressure signals and triggers the explosion suppression equipment if the pressure within the protected area rises at a rate higher than a pre-selected threshold rate or if the absolute pressure exceeds an absolute threshold level. The controller also provides a warning if the pressure rises above a pre-selected absolute warning level that is less than the threshold level.

In accordance with one aspect of the invention, the controller samples the transducer every 200 $\mu$Sec to obtain a series of successive pressure measurements. The controller then stores the sampled pressure measurements in a memory table having approximately five positions. Each time the table is filled, the controller averages the five pressure measurements to obtain an integrated mean pressure value having a sample time of 1 mSec and then erases the table for subsequent measurements. This results in the calculation of a series of successive mean pressure values each having a sample time of 1 mSec.

In accordance with another aspect of the invention, the controller stores the mean pressure values in an ROR (rate of rise) table having approximately 5–25 positions each corresponding to a 1 mSec time period. The length of the table, which is user-configurable to account for the volume size and the expected Kst of the protected area, determines the dt value for the dP/dt calculation discussed below. For example, if the ROR table has ten positions, dt=10.

The controller stores the mean pressure values in the table starting at the top and working down until the table overflows, at which time the controller overwrites the mean pressure values beginning at the top of the table with new mean pressure values. Therefore, when the table has been filled, the latest value written in the table is always the mean pressure value for the most current mSec period and the value below it in the table is always the mean pressure value that was measured "dt" times before (5–25 mSec before, depending on the length of the table).

The controller accesses the ROR table to calculate a dP/dt validation rate every mSec by taking the most recent mean pressure value in the table and subtracting the mean pressure value that is in the next lower line of the table and dividing this difference by the dt value (5–25 mSec, depending on the length of the table). The controller then compares each calculated dPldt validation rate every mSec to a predetermined threshold dP/dt rate and triggers the explosion suppression equipment if any of the calculated dPldt validation rates exceed the threshold rate.

The present invention provides numerous advantages not found in prior art detector assemblies. For example, by sampling the transducer approximately every 200 $\mu$Sec and then averaging five of these sampled pressure measurements to obtain a mean pressure value, the controller "filters out" any pressure spikes caused by electro-magnetic interferences or momentary pressure variations to prevent inadvertent triggering of the suppression equipment.

Additionally, by storing approximately 5–25 of the mean pressure values in a user configurable ROR table and then calculating dP/dt validation rates as described above, the detector can quickly and accurately detect rapid pressure increases and trigger the suppression equipment within a single mSec without having to validate the detected pressure rise with several additional readings. This enables the explosion protection system to detect and extinguish deflagrations in their incipient stages.

Moreover, by using a user-configurable ROR table to calculate dP/dt rates, the sensitivity of the detector can be quickly and easily modified by simply adjusting the length of the table.

BRIEF DESCRIPTION OF THE DRAWING FIGURES

A preferred embodiment of the present invention is described in detail below with reference to the attached drawing figures, wherein:

FIG. 3 is a graph and memory table illustrating the calculation of a dP/dt validation rate;

FIG. 4 is a graph illustrating a momentary pressure disturbance caused by a pressure variation or electromagnetic interference in the protected area; and FIG. 5 is a graph illustrating several exemplary pressure curves and the points on the curves where the suppression equipment is triggered by the detector assembly of the present invention.

DETAILED DESCRIPTION OF THE PREFERRED EMBODIMENTS

Figure 1:
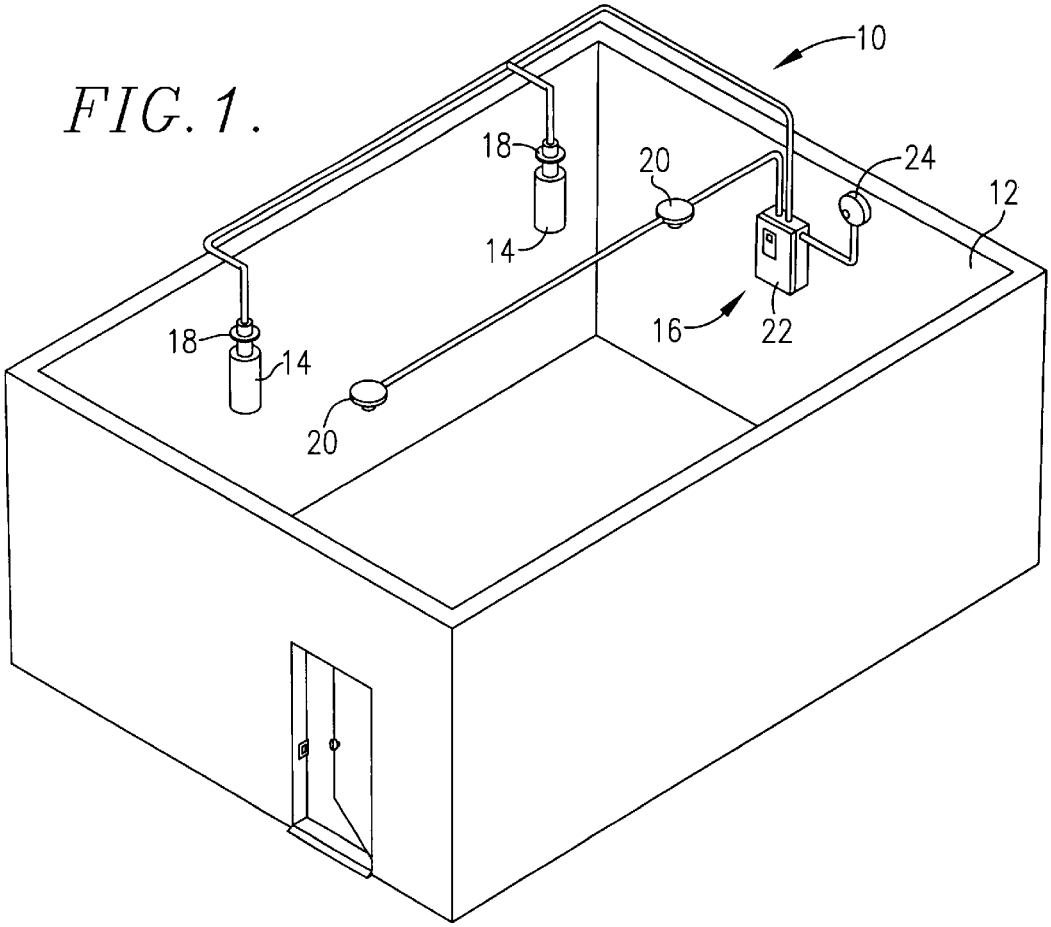
FIG. 1 is an isometric view of an explosion detection and suppression system constructed in accordance with a preferred embodiment of the invention and shown installed in a protected area.

Turning now to the drawing figures and particularly FIG. 1, an explosion detection and suppression system 10 constructed in accordance with a preferred embodiment of the present invention is shown installed in a protected area 12. The system broadly includes one or more containers 14 that are spaced throughout the protected area and that each have pressurized suppressant material stored therein and a detector assembly 16 for monitoring the pressure in the protected area and for triggering the release of the suppressant material from the containers during explosive conditions. The protected area may be any enclosed area that is subject to the build-up of explosive conditions such as a bag house, grain elevator, tank, or other industrial or commercial enclosure.

In more detail, the containers 14 are conventional and each includes an internal rupture disk (not shown) and an electrically responsive initiator 18. The rupture disks retain the pressurized suppressant material in the containers when the protected area is under normal operating conditions. During explosive conditions, the initiators rupture or break the rupture disks after receiving a triggering signal from the detector assembly 16 to release the suppressant material from the containers for suppressing an explosion in the protected area.

The detector assembly 16 broadly includes one or more pressure sensors or transducers 20 spaced throughout the protected area 12, a controller 22 electrically coupled with the sensors and the initiators 18, and an alarm device 24 coupled with the controller. The detector assembly may also be coupled with other devices such as a remote monitoring station (not shown).

The transducers 20 are conventional and are each operable to continuously measure the pressure in the protected area 12 and to generate representative output signals. The output signals are preferably 4–20 mA analog current signals. The transducers may also be configured to measure other parameters within the protected area such as smoke, heat, dust, or gases related to the build-up of explosive pressures.

The controller 22 monitors the pressure signals from the transducers 20 and triggers the initiators 18 to release the suppressant material in the containers 14 during explosive conditions. More particularly, the controller is configured to trigger the initiators if the pressure within the protected area rises at a rate higher than a preselected threshold rate or if the pressure exceeds an absolute threshold level. The controller may also energize the alarm device 24 to provide a warning if the pressure rises above a pre-selected absolute warning level that is less than the threshold level.

Figure 2:
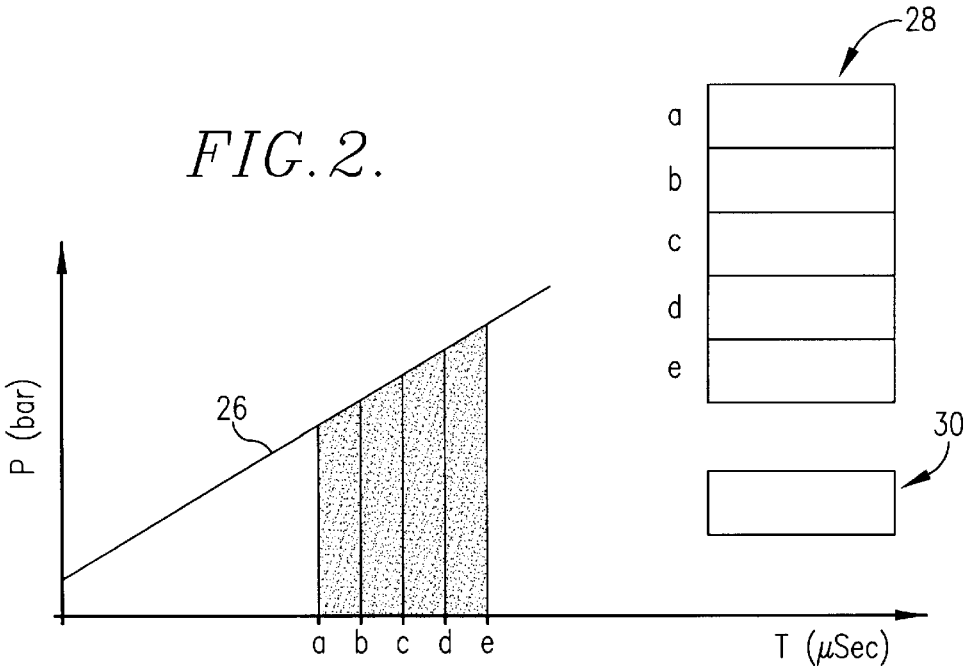
FIG. 2 is a graph and memory table illustrating the sampling of the transducer and the calculation of a mean pressure value.

To calculate the rate of pressure rise in the protected area, the controller 22 first converts the analog output signals from the transducers 20 to digital signals. To this end, the controller includes an internal current-to-voltage converter-that first converts the 4–20 mA transducer output signals to 0–5 V analog signals and an internal analog-to-digital converter that converts the 0–5 V signals to 8-bit digital numbers. FIGS. 2 and 3 illustrate exemplary digital pressure signals 26 generated by the controller.

In accordance with one aspect of the invention, the controller 22 samples each transducer 20 every 200 $\mu$Sec to obtain a series of 5 successive pressure measurements spanning a 1 mSec period. Five exemplary samples are identified by the letters a–e in FIG. 2. The controller then stores each of the five successive pressure measurements in a first memory table 28 having five positions. The memory table may be stored in any solid state memory device such as a chip.

When the memory table 28 is filled with five pressure measurements, the controller 22 averages the measurements to obtain an integrated mean pressure value having a sample time of 1 mSec. This mean pressure valve is temporarily stored in another memory position 30. The controller then erases the table and successively fills it with the next five sampled pressure measurements and then averages these measurements to obtain another integrated mean pressure value having a sample time of 1 mSec. The controller continuously repeats these steps, resulting in the calculation of a series of successive mean pressure values each having a sample time of 1 mSec.

In accordance with another aspect of the invention, the controller 22 stores the series of successive mean pressure values in an ROR (rate of rise) table 34 as depicted in FIG.

3. The table preferably has between 5 and 25 positions, each corresponding to a 1 mSec time period. The number of positions in the table determines the dt for the dP/dt calculations as described below.

The controller 22 stores the mean pressure values in the ROR table 34 starting at the top and working toward the bottom until the table overflows, at which time the mean pressure values beginning at the top of the table are overwritten with new mean pressure values. Therefore, once the table has been filled, the latest value written in the table is always the mean pressure value for the most current mSec period and the value below it in the table is always the mean pressure value that was measured "dt" times before (5–25 mSec before, depending on the length of the table).

The controller 22 then calculates a dP/dt validation value every mSec by taking the most recent mean pressure value from the table 34 and subtracting the mean pressure value that is in the next lower line and dividing this difference by the dt value (5–25 mSec, depending on the length of the table). For the example illustrated in FIG. 3, which has an ROR table with 10 positions and therefore a dt value of 10, the dP/dt validation value at 10 mSec would be (P2–P1)/10.

Each time the controller 22 calculates a new dP/dt validation value, it compares the calculated dP/dt validation value to a predetermined threshold dP/dt rate. If any of the calculated dP/dt validation values exceed the threshold rate, the controller triggers the initiators 18 to release the suppressant material from the containers 14.

To ensure accurate measurements, the pressure change (dP) that must be measured in the protected area 12 to trigger the initiators 18 is selected to be approximately five percent (5%) of the range of the transducers 20. For example, if the transducers have a range of 660 mbars, the pre-selected dP portion of the dP/dt threshold should be approximately 33 mbars.

Because the dP portion of the dP/dt threshold rate should always remain fixed as described above, the dt value must be altered if it is desired to adjust the threshold rate at which the suppression equipment is triggered. In the present invention, the length of the ROR table determines the dt of the dP/dt threshold. For example, if the table has five positions, the dt value equals five. Accordingly, to permit adjustment of the dP/dt threshold rate and therefore the sensitivity of the detector assembly 16, the controller 22 includes software that permits the length of the table 34 to be user-selected to account forthe volume size and the expected Kst of the protected area. For example, the user may select a table with five storage positions to obtain a dP/dt threshold rate of approximately 100 psi/second, or a table with twenty-five storage positions to obtain a dP/dt threshold rate of approximately 20 psi/second.

The manner in which the controller 22 calculates the rate of pressure rise in the protected area offers several advantages. For example, the sampling and averaging functions of the controller 22 "filter out" any pressure spikes caused by electromagnetic interferences or momentary pressure variations that occur in the protected area 12. For example, if a pressure spike 32 such as the one illustrated in the graph of FIG. 4 occurs, it will likely only be present during one of the 200 $\mu$Sec sample periods. The controller's averaging function averages the spike with other normal measurements so that the spike does not cause an inadvertent triggering of the suppression equipment.

Applicant has discovered that an averaging function that uses a memory table 28 with five positions adequately prevents inadvertent triggering of the initiators 18 caused by momentary pressure fluctuations and electromagnetic disturbances. However, those skilled in the art will appreciate that a memory table having a different number of positions may also be used without departing from the scope of the present invention.

The use of the ROR table 34 also contributes to the accuracy and responsiveness of the present invention. Specifically, by storing 5–25 of the mean pressure values in the ROR table and then calculating dP/dt validation values as described above, the detector assembly 16 can accurately detect rapid pressure increases and then quickly trigger the suppression equipment within a single mSec without having to validate the detected pressure rise with several additional readings. This provides a more rapid and reliable triggering of the suppression equipment so that deflagrations can be detected in their incipient stages and extinguished.

The curve 36 in FIG. 5 illustrates the detection of a rapid pressure increase in the protected area 12 by the detector assembly 16 of the present invention. The curve initially increases gradually but then begins to rise rapidly due to a rapid build-up of pressure within the protected area. At the point 38 depicted on the curve, the detector assembly detects a rate of pressure rise that exceeds the dP/dt threshold rate and triggers the suppression equipment. This suppresses the explosion as indicated by the downturn in the curve 36 after the point 38.

The curve 40 in FIG. 5 illustrates the detection of a gradual pressure increase that does not exceed the dP/dt threshold rate but that does eventually exceed an absolute pressure threshold level. The curve increases gradually over time and rises above a warning pressure level at point 42. At this point, the detector assembly 16 energizes the alarm device 24 or sends a warning signal to an operator. To prevent the controller 22 from energizing the alarm device and then immediately thereafter triggering the suppression equipment if the pressure continues to rise rapidly, the controller may be equipped with a delay so that the measured pressure value must exceed the warning level for a period of 50 mSecs, or 250 sample periods before the alarm device 24 is energized.

If the pressure in the protected area 12 continues to rise as depicted by the curve 40, it eventually rises above the threshold pressure level at point 44. At this point, the detector assembly 16 triggers the suppression equipment to suppress the explosion.

When the controller 22 triggers the suppression equipment, it also preferably stores the measured pressure values that occurred immediately before and after the triggering for later analysis.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A method of calculating the rate at which a parameter rises in an enclosed area, the method comprising the steps of:

a. measuring the parameter with a sensor to generate a sensor signal representative of the parameter;

b. periodically sampling the sensor signal to obtain a number of successive sampled measurements;

c. successively storing the sampled measurements in a memory;

d. averaging the stored measurements at a pre-determined time interval to obtain a mean value;

e. storing the mean value in the memory;

f. repeating steps (b)–(e) to obtain and store a number of successive mean values in the memory; and g. calculating the rate at which the parameter rises in the enclosed area by comparing at least two of the mean values.

2. The method as set forth in claim 1, step (g) comprising the step of determining the difference between a mean value that has been in the memory the longest amount of time and a mean value that has been in the memory the shortest amount of time and dividing the difference by the number of mean values in the memory.

3. The method as set forth in claim 2, further including the step of comparing the calculated rate to a pre-determined threshold rate and triggering suppression equipment if the calculated rate exceeds the threshold rate.

4. The method as set forth in claim 1, wherein step (b) comprises sampling the sensor signal approximately every 200 $\mu$Sec.

5. The method as set forth in claim 1, step (c) comprising storing the sampled measurements in a first memory table until five measurements have been stored.

6. The method as set forth in claim 5, step (d) comprising averaging the five stored measurements to obtain the mean measurement.

7. The method as set forth in claim 5, wherein approximately 5–25 of the mean values are stored in a second memory table.

8. The method as set forth in claim 7, further including the step of continuously updating the second memory table after the 5–25 mean values have been stored by successively replacing the mean value that has been in the second memory table the longest with the most current mean value.

9. The method as set forth in claim 1, the parameter being pressure in the enclosed area.

10. The method as set forth in claim 1, the sensor comprising a pressure sensor.

11. A rate of rise detector for detecting when a measured parameter in an enclosed area rises at an unsafe rate, the detector comprising:

a sensor for measuring the parameter and generating a sensor signal representative of the parameter; and a controller operably coupled with the sensor and configured to: periodically sample the sensor signal to obtain a plurality of successive sampled measurements; store the sampled measurements in a memory; average the stored measurements at pre-determined time intervals to obtain a series of successive mean values; store the mean values in the memory; and calculate the rate at which the parameter rises by comparing at least two of the mean values.

12. The detector as set forth in claim 11, the controller further being operable to compare the calculated rate to a pre-determined threshold rate and to trigger suppression equipment when the calculated rate exceeds the threshold rate.

13. The detector as set forth in claim 11, the controller being further operable to calculate the rate by determining the difference between the mean value that has been in the memory the longest amount of time and the mean value that has been in the memory the shortest amount of time and dividing the difference by the number of mean values in the memory.

14. The detector as set forth in claim 11, the controller further being operable to sample the sensor signal approximately every 200 $\mu$Sec.

15. The detector as set forth in claim 11, the controller further being operable to store the sampled measurements in a first memory table until five measurements have been stored.

16. The detector as set forth in claim 15, the controller further being operable to average the five stored measurements to obtain the mean values.

17. The detector as set forth in claim 15, the controller further being operable to store approximately 5–25 of the mean values in a second memory table.

18. The detector as set forth in claim 17, the controller further being operable to continuously update the second memory table after the 5–25 mean values have been stored by successively replacing the mean value that has been in the second memory table the longest with the most current mean value.

19. The detector as set forth in claim 11, the parameter being pressure in the enclosed area.

20. The detector as set forth in claim 19, the sensor comprising a pressure sensor.

* * * * *